United States Patent [19]

Peters et al.

[11] Patent Number: 4,755,084

[45] Date of Patent: Jul. 5, 1988

[54] MULTI-PART ROOF-CONTACTING STRUCTURES OF MINE ROOF SUPPORTS

[75] Inventors: Bernd Peters, Dülmen; Harry Rosenberg, Lüdinghausen; Walter Weirich, Dortmund, all of Fed. Rep. of Germany

[73] Assignee: Gewerkschaft Eisenhutte Westfalia GmbH, Postfach, Fed. Rep. of Germany

[21] Appl. No.: 13,411

[22] Filed: Feb. 11, 1987

[30] Foreign Application Priority Data

Feb. 19, 1986 [DE] Fed. Rep. of Germany ..... 3605236

[51] Int. Cl.[4] ..... E21D 17/00

[52] U.S. Cl. ..... 405/294; 405/293; 405/302

[58] Field of Search ..... 405/291, 292, 293, 294, 405/295, 296, 297, 299, 302; 299/31, 33; 91/170 MP

[56] References Cited

U.S. PATENT DOCUMENTS

| | | | |
|---|---|---|---|
| 3,534,559 | 10/1970 | Seddon et al. | 405/297 |
| 4,347,021 | 8/1982 | Elsner et al. | 405/291 X |
| 4,411,558 | 10/1983 | Rutherford | 405/299 |
| 4,465,408 | 8/1984 | Krieger et al. | 405/293 X |

FOREIGN PATENT DOCUMENTS

| | | |
|---|---|---|
| 8224441 | 2/1983 | Fed. Rep. of Germany . |
| 3401003 | 7/1985 | Fed. Rep. of Germany . |

*Primary Examiner*—David H. Corbin

*Attorney, Agent, or Firm*—Samuels, Gauthier, Stevens & Kehoe

[57] ABSTRACT

A mine roof support has a slidable extension at the front end of an auxiliary roof cap pivoted for swinging up and down on a main cap. To prevent the extension from being extended when the angle of inclination of the auxiliary cap is too high an insulative cylindrical block is fitted to say the auxiliary cap to partially rotate as the auxiliary cap pivots. A flattened region on the block supports a metallic plate and indexes as the auxiliary cap pivots. A resiliently-mounted proximity switch on the main cap senses the presence of the plate and produces a signal to prevent the extension from being extended.

3 Claims, 2 Drawing Sheets

MULTI-PART ROOF-CONTACTING STRUCTURES OF MINE ROOF SUPPORTS

FIELD OF THE INVENTION

The present invention relates to mineral mining installations and more particularly to roof supports which employ multi-part roof contacting structures.

BACKGROUND OF THE INVENTION

Roof supports of mining installations often have a roof canopy composed of a main cap supported on hydraulic props, and an auxiliary cap which can be swung up and down at the front of the main cap. A sliding cap or extension may be mounted to the auxiliary cap and is extended from time to time in accordance with the advancement of a conveyor. In this way the roof canopy can be progressively advanced to follow up the winning progress and prevent roof collapse. In installations of this type there is a risk that if the auxiliary cap becomes too steeply inclined due to an undulating or broken roof the extension will be displaced downwardly into the path of the machinery working on the face. Hydraulic controls are known which function to prevent the extension from being advanced if the auxiliary cap is inclined at more than a predetermined extent. For example, DE-GM 82 24 441 and DE-OS 3 401 003 describe a shut-off valve that is operated mechanically in accordance with the angle of inclination of the auxiliary cap. Such controls are prone to certain difficulties because they require accurate mountings and excessive clearance in the main pivot joints tends to prevent this.

A general object of the present invention is to provide an improved form of control device.

SUMMARY OF THE INVENTION

The present invention provides an improved control device for detecting the angle of inclination between the main and auxiliary caps of a support to enable the advancement of the extension of the auxiliary cap to be prevented when the angle is too great. The device consists of a cylindrical component mounted to one of the caps in question and a proximity switch mounted with resilient means such as a strip of leaf spring to the other of the caps. The switch senses the periphery of the cylindrical body which performs relative rotary movements as the caps pivot. An indexing zone on the body may actuate the switch to produce a signal when the movement becomes too great. The indexing zone may be a flattened region of an insulative body equipped with a metal conductive plate.

Any play in the pivot joint or joints between the caps no longer affects the device because the resilient mounting can compensate for this. Moreover, the sensing function is considerably improved since physical contact is no longer necessary.

The invention may be understood more readily and various other aspects and features of the invention, may become apparent from consideration of the following description.

BRIEF DESCRIPTION OF THE DRAWINGS

An embodiment of the invention will now be described, by way of example only, with reference to the accompanying drawings, wherein.

DESCRIPTION OF THE PREFERRED EMBODIMENTS

Figure 1:
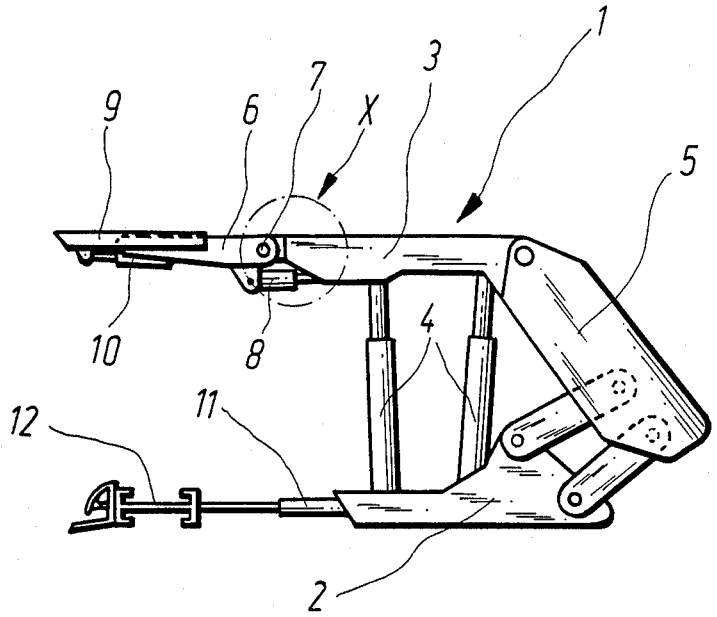
FIG. 1 depicts a support constructed in accordance with the invention.
Figure 2:
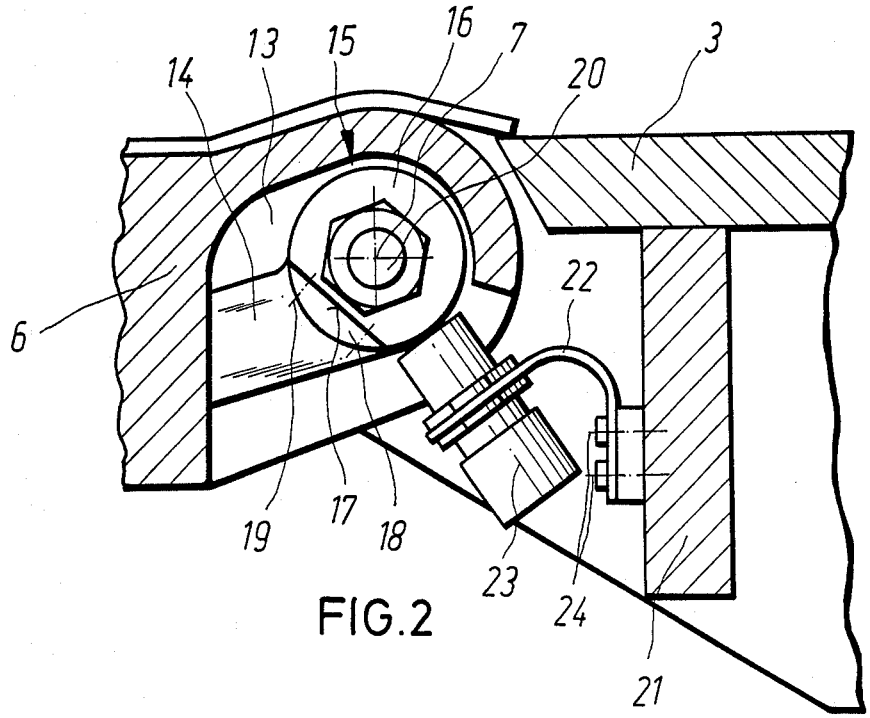
FIG. 2 is an enlarged sectional side view of part of the support in the region marked X in FIG. 1.
Figure 3:
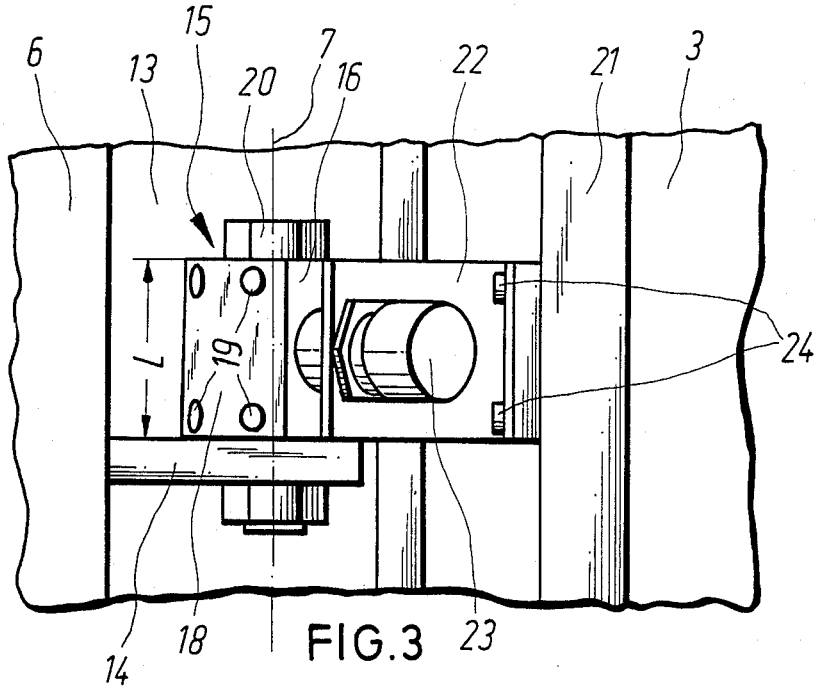
FIG. 3 in an inverted plan view of the part of the support shown in FIG. 2.

As shown in FIG. 1, an underground mineral mining installation has a scraper-chain conveyor 12 linked with shifting rams 11 to roof supports 1. Each support 1 comprises a floor sill structure 2, a roof-engageable structure 3 and hydraulic props 4 interposed therebetween. The roof-engageable structure 3 has a main cap 3 with an auxiliary cap 6 which is raisable and lowerable at its front end. The auxiliary cap 6 is pivotably mounted to the main cap 3 with one or more pivot joints 7 and a piston and cylinder unit 8 serves to pivot the auxiliary cap 6 up and down. A goaf shield 5 and 'lemniscate' guide linkage are articulated between the near end of the cap 3 and the floor sill structure 2. The auxiliary cap 6 has a further slidable extension 9 at its front end and one or more piston and cylinder units 10 are provided for selectively extending and retracting the extension 9 relative to the auxiliary cap 6. The unit or units 10 are controlled as to their operation in conjunction with the shifting rams 11. Thus the extension 9 is displaced out towards the mineral face to the same exent that the conveyor 12 is advanced. In order to prevent the unit or units 10 from extending if the angle of inclination of the auxiliary cap 6 is too high, the support 1 is provided with a control device depicted in more detail in FIGS. 2 and 3. The device has a main body 15 fitted in an aperture 13 in the region of the pivot joint 7 or one of the pivot joints 7. The body 15 is secured to a wall or beam 14 of the cap 6 by a bolt 20. The body 15 is composed of a cylindrical component 16 preferably made from a non-metallic material such as 'Ultramide' and a metallic plate or contact 18 affixed to the component 16 and extending over the length L (FIG. 3). The plate 18 can be made from stainless steel and is secured by screws 19 to a flattened region 17 on the periphery of the component 16. The device further comprises a proximity switch 23 connected by a shaped leaf spring 22 to a rib 21 of the main cap 3. The switch 23 has a sensor or feeler on or near the periphery of the component 16. At a certain angle of inclination between the caps 3, 6 the plate 18 is moved into the vicinty of the sensor of the switch 23 to produce an electrical signal. This signal is detected by the control system pertaining to the installation and the unit or units 10 of the support 1 are prevented from operating.

We claim:

1. In a mine roof support having a roof-engageable structure composed of a main cap, an auxiliary cap pivotably mounted to the main cap and an extension slidably displaceable relative to the auxiliary cap to extend or retract in relation to the auxiliary cap; an improved device for detecting an angle of inclination between the main and auxiliary caps; said device comprising a cylindrical component, means for mounting the component to one of the main and auxiliary caps for pivotal movement therewith, a proximity switch, resilient means for mounting the proximity switch to the other of the main and auxiliary caps at a sensing position with respect to the cylindrical component, and an indexing zone on the cylindrical component, the switch being sensitive to the presence of the indexing zone and being insensitive to the remainder of the cylindrical component, the relative positions of the switch and the indexing zone being such that the switch senses the presence of the indexing zone and being insensitive to the partial rotation occurs between the cylindrical component and the switch in response to pivotal movement between the main cap and the auxiliary cap to said angle of inclination, the switch serving to produce a signal when the switch senses the presence of the indexing zone of the component.

2. A support according to claim 1, wherein the cylindrical component is composed of a non-metallic insulative material and the indexing zone is a flattened portion on which is mounted a metallic conductive plate.

3. A support according to claim 1, wherein the resilient mounting is a leaf spring.

* * * * *